United States Patent [19]

Kawamura

[11] 3,972,142

[45] Aug. 3, 1976

[54] SHOT GUN

[76] Inventor: Takeji Kawamura, 1099-11 Ishinazaka-cho, Hitachi, Ibaragi, Japan

[22] Filed: Nov. 29, 1974

[21] Appl. No.: 528,152

[52] U.S. Cl. ..... 42/69 R; 42/41

[51] Int. Cl.² ..... F41C 19/00

[58] Field of Search ..... 42/69 R, 69 B, 41, 42 R; 89/144, 146

[56] References Cited

UNITED STATES PATENTS

| | | | |
|---|---|---|---|
| 2,675,638 | 4/1954 | Crittendon | 42/69 B |
| 2,685,754 | 8/1954 | Crittendon | 42/69 B |
| 2,855,716 | 10/1958 | Campbell | 42/69 B |

*Primary Examiner*—Charles T. Jordan

*Attorney, Agent, or Firm*—Thompson, Birch, Gauthier & Samuels

[57] ABSTRACT

A shot gun, wherein a pulled trigger causes a disconnector to push a sear for rotation, thereby disengaging a hammer from the sear; the hammer normally urged by a plunger assembly forcefully rotates when released from the sear and impinges on the firing pin of a breech bolt; and the disconnector is provided with an engagement member which is engaged with the plunger assembly upon rotation of the hammer to release the sear from a state pushed by the disconnector.

8 Claims, 3 Drawing Figures

SHOT GUN

BACKGROUND OF THE INVENTION

This invention relates to a shot gun, and more particularly to a shot gun provided with a spontaneous discharge stop device.

Already known are various types of shot guns which are equipped with a device for preventing a cartridge from being spontaneously fired, in case the trigger still remains pulled even after a first discharge. For example, a shot gun has been proposed wherein a safety lever is rotatably fitted to a trigger guard plate and rotated from a neutral position to an operating position for engagement with a disconnector or trigger to restrict its actuation, thereby preventing the spontaneous discharge of a cartridge. With this type of shot gun, the safety lever generally has to be returned to its neutral position each time before a cartridge is fired again. Particularly the type which automatically carries out said return operation has the drawback that it has a complicated mechanism. Recently, another type of shot gun has been proposed wherein a locking lever is concentrically disposed with a hammer to be operated therewith. With this type of shot gun, where the hammer is rotated to strike a firing pin, the locking lever moves with the hammer. At this time, one end of said locking lever actuates a coupler, which in turn rotates a disconnector to release a sear from a state pushed by the disconnector. When the sear is released, the disconnector only slides over the upper surface of the sear and does not push the sear, unless the trigger is brought back to its original position. As the result, the hammer remains engaged with the sear, preventing the spontaneous discharge of a cartridge. The other end of said locking lever is fitted into the groove of a slider, when the trigger is not pulled, namely, under a normal condition, thereby restricting the movement of the slider. Consequently, the locking block locks a firing pin to prevent the spontaneous discharge of a cartridge. However, this latter prior art type of shot gun has the drawback that not only the hammer and locking lever are interlocked by complicated mechanisms, but also the locking lever drives the disconnector through a coupler, resulting in an unavoidable time delay.

Further with any prior art shot gun a cartridge is not regularly positioned but left free in a carrier and sometimes is inclined to the axial line of the shot gun, presenting difficulties in properly advancing into a magazine, and leading to a spontaneous discharge. As mentioned above, the prior art shot gun is not only expensive due to complicated mechanisms but also is liable to give rise to the spontaneous discharge of a cartridge.

SUMMARY OF THE INVENTION

It is accordingly the object of this invention to provide a shot gun equipped with a spontaneous discharge stop device of simple arrangement. To this end, a shot gun according to this invention has a disconnector provided with an engagement member, which, when a bias mechanism is actuated to rotate a hammer, is engaged with said bias mechanism to release the sear from a state pushed by the disconnector. Further, with the shot gun of this invention, a locking lever is provided with an abutting surface pressed against a cartridge to prevent it from being inclined to the axial line of the shot gun.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENT

Figure 1:
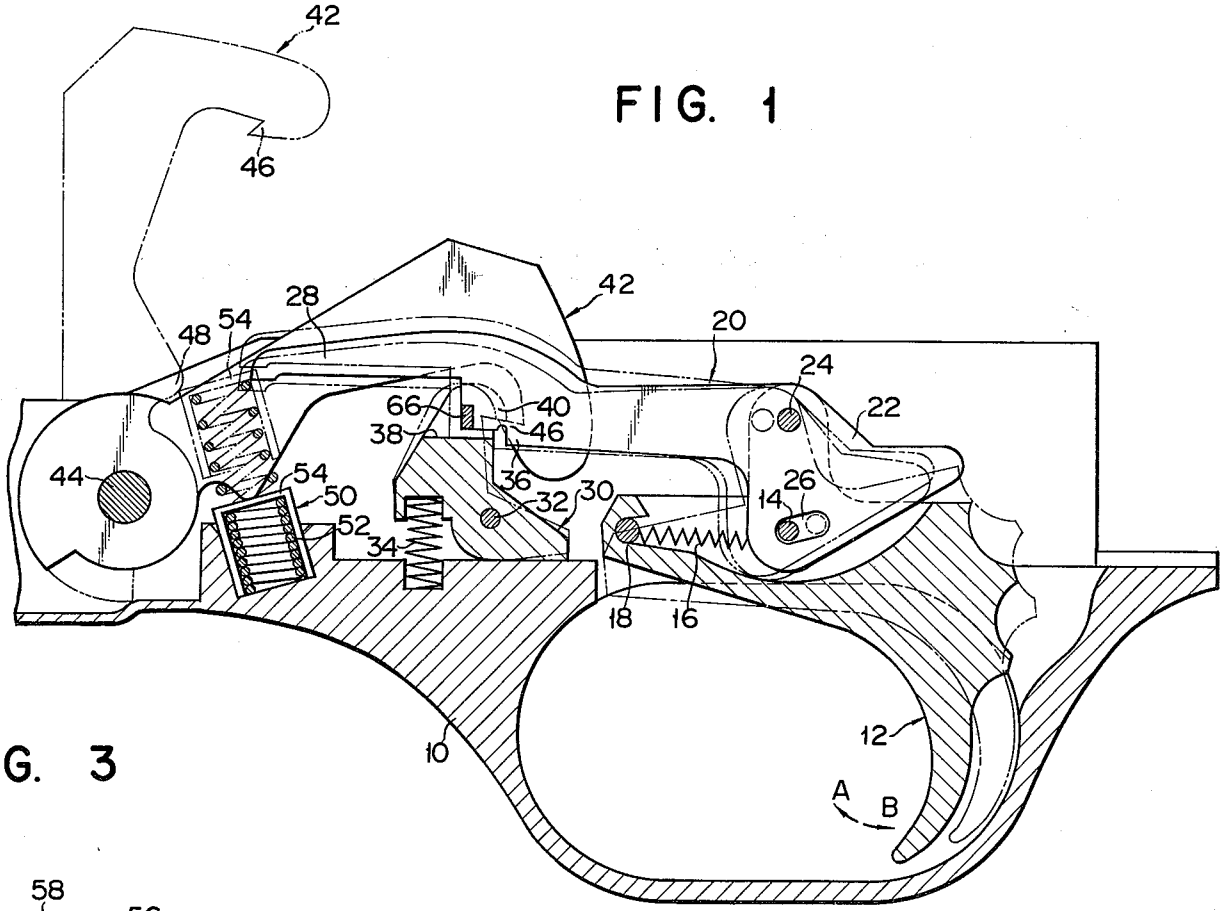
FIG. 1 is a sectional side view of a shot gun according to a preferred embodiment of this invention.

There will now be described by reference to FIGS. 1 to 3 the preferred embodiment of this invention. Throughout FIGS. 1 and 2, referential numeral 10 denotes a trigger guard housing in which a trigger 12 is rotatably supported by a trigger pin 14. One end of a compression coil spring 16 abuts against the trigger 12, and the other end of said spring 16 is pressed against a pin 18 fitted to the trigger 12. Accordingly, the trigger 12 is normally urged to rotate about the trigger pin 14 counterclockwise namely, in the direction of the indicated arrow A. A disconnector 20 is swingably supported at one end 22 in the trigger 12 by means of a disconnector pin 24. The connecting end portion 22 of said disconnector 20 has a substantially triangular form. The lower part of said triangular connecting end portion 22 of the disconnector 20 is bored with an elongate hole 26 into which the trigger pin 14 is loosely fitted. The other end portion 28 of the disconnector 20 extends sufficiently long to form an engagement member engageable with the later described plunger assembly.

Below the proximity of the substantially central part of the disconnector 20, a sear 30 is rotatably supported on the housing 10 by means of a sear pin 32. The sear 30 is normally urged by a sear spring 34 to rotate clockwise about the sear pin 32. The disconnector 20 has a pushing portion 36 disposed near the side wall of the sear 30. The sear 30 is provided with a holding portion 38 on which said pushing portion 36 is slidably held and a pawl 40 releasably engaged with the later described hammer.

A hammer 42 is swingably supported on the housing 10 by means of a hammer pin 44 and provided with a pawl 46 engaged with the pawl 40 of the sear 30 and a projection 48 pressed against the later described plunger assembly, thereby normally effecting engagement with the sear 30.

A plunger assembly 50 comprises a hammer compression coil spring 52 and a hammer plunger 54 cap-shaped to enclose said spring 52 and actuated to push the projection 48 of the hammer 42. Said plunger assembly 50 is wholly embedded in the housing 10.

A locking lever 56 is supported on the housing 10 by a locking lever pin 58 so as to rotate concentrically with, but independently of, the hammer 42. Said locking lever 56 has a notch 60 cut out at one end and a locking portion 62 formed at the other end. This locking portion 62 not only abuts against a cartridge to prevent it from being inclined to the axial line of the shot gun, but also is made engageable with the groove of a slider (not shown). The disconnector 20 has a projection 66 loosely engaged with the notch 60.

There will now be described by reference to FIG. 1 the operation of the respective members of a shot gun according to this invention. When the trigger 12 normally urged by the compression coil spring 16 in the direction of the indicated arrow A, is pulled backward in the direction of the indicated arrow B, then the connecting end portion 22 coupled with the trigger 12 by the disconnector pin 24 slides forward (to the left side of FIG. 1) jointly with the trigger 12. At this time, the trigger pin 14 is shifted to the left side of the elongate hole 26. When sliding, the disconnector 20 has its pushing portion 36 pressed against the side wall of the sear 30, thereby causing the sear 30 to rotate counterclockwise about the sear pin 32 against the urging force of the sear spring 34.

The rotation of the sear 30 releases the pawl 46 of the hammer 42 from the pawl 40 of the sear 30. At this time, the plunger assembly 50 is pressed against the projection 48 of the hammer 42, supplying said hammer 42 with a force to rotate counterclockwise about the hammer pin 44. When, therefore, the pawls 40, 46 are disengaged from each other, the hammer 42 forcefully rotates counterclockwise vigorously to hit a firing pin (not shown) for the discharge of a cartridge. The chained lines of FIG. 1 show the positions of the respective members of the shot gun after the trigger 12 is pulled in the direction of the indicated arrow B.

The plunger assembly 50 projects out of the housing 10 with the rotation of the hammer 42 and abuts against the engaging end portion 28 of the disconnector 20 which is positioned above the plunger assembly 50, thereby pushing said end portion 28 upward, namely causing the disconnector 20 to rotate clockwise about the disconnector pin 24. The above-mentioned operation is indicated by the chained lines of FIG. 1 and the solid lines of FIG. 2. The elongate hole 26 is obviously so shaped as to represent the segment of an imaginary circle with the disconnector pin 24 taken as the center in order to be prevented from striking against the trigger pin 14 when the disconnector 20 makes a clockwise rotation.

Where the disconnector 20 rotates clockwise by being pushed upward by the plunger assembly 50, the pushing portion 36 of said disconnector 20 no longer pushes the side wall of the sear 30. Accordingly, the sear 30 is rotated clockwise to its original position by the urging force of the sear spring 34.

Figure 2:
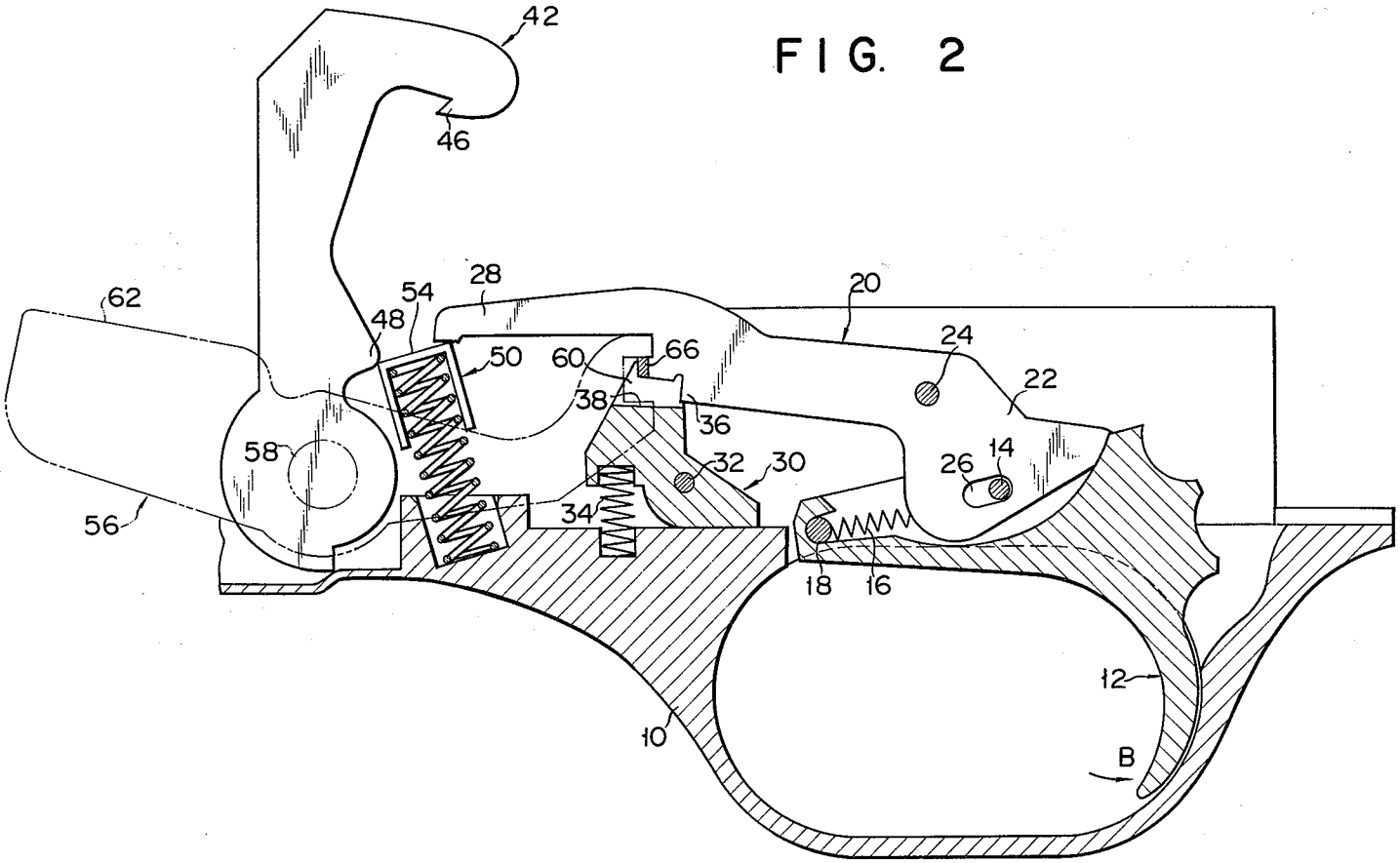
FIG. 2 is a sectional side view of the same, where a disconnector is rotated by a plunger assembly.

As seen from FIG. 2, the above-mentioned clockwise rotation of the disconnector 20 causes its projection 66 to be moved upward jointly with the notch 60 of the locking lever 56 by being pressed against the upper inner wall of said notch 60. As the results the locking lever 56 rotates counterclockwise about the locking lever pin 58, causing the locking portion 62 of the locking lever 56 to be brought downward. When brought downward, the locking portion 62 is not fitted into the groove of a slider (not shown) on which a breech bolt (not shown) is mounted. Therefore, the firing pin is not restricted in operation, but attains the discharge of a cartridge.

When released from a pulling force after discharge of a cartridge, the trigger 12 is rotated backward in the direction of the indicated arrow A by the urging force of the trigger spring 16 to regain its original position. When a receiver housing (not shown) is brought backward the disconnector 20 also slides backward with the counterclockwise rotation of the trigger 12. The hammer 42 rotates clockwise about the hammer pin 44 against the pushing force of the plunger assembly 50. As the result, the pawl 46 of the hammer 42 is again brought into engagement with the pawl 40 of the sear 30. The clockwise rotation of the hammer 42 brings down the plunger assembly 50 to its original position. As the result, the engaging end portion 28 of the disconnector which was previously pushed upward by the plunger assembly 50 also falls. Thus the projection 66 of the disconnector 20 is pressed against the lower inner wall of the notch 60, causing the locking lever 56 to rotate clockwise about the locking lever pin 58. At this time, the locking portion 62 of the locking lever 56 is lifted to be fitted into the groove of a slider (not shown), thereby restricting the operation of a firing pin (not shown) for prevention of the spontaneous discharge of a cartridge. Further, the locking portion 62 of the locking lever 56 abuts against a cartridge to prevent it from being inclined to the axial line of the shot gun. Therefore, the spontaneous discharge of a cartridge is suppressed in this respect, too.

When, under the above-mentioned condition, the trigger 12 is pulled again in the direction of the indicated arrow B, then the hammer 42 is rotated counterclockwise by the plunger assembly 50 through the previously described steps. Immediately upon the counterclockwise rotation of the hammer 42, the locking lever 56 is also rotated counterclockwise by the projection 66 of the disconnector 20 to release the locking portion 62 of the locking lever 56 from the groove of a slider (not shown), bringing a firing pin (not shown) to a state ready for the discharge of a cartridge. Namely, the hammer 42 vigorously hits the firing pin to discharge the succeeding cartridge.

If, in this case, the trigger 12 happens to remain pulled without being fully brought back to its original position after the discharge of a cartridge, the pushing portion 36 of the disconnector 20 only slides over the surface of the holding portion 38 of the sear 30 and does not push the side wall of the sear 30. Since, at this time, the sear is not rotated, nor the pawl 40 of the sear 30 and the pawl of the hammer 42 are disengaged from each other, the hammer 42 is not rotated counterclockwise for prevention of the spontaneous discharge of a cartridge.

Figure 3:
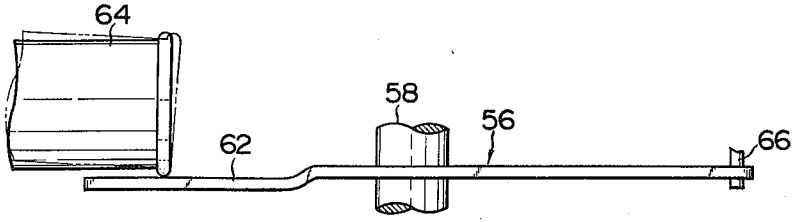
FIG. 3 is a plan view of a locking lever pressed against a cartridge.

Under the above-mentioned condition, the projection 66 of the disconnector 20 is located above its original position to rotate the locking lever 56, thereby bringing down the locking portion 62 of said locking lever 56. Accordingly, the locking portion 62 is fitted into the groove of a slider (not shown) to restrict the operation of a firing pin (not shown) for prevention of the spontaneous discharge of a cartridge:

FIG. 3 illustrates the condition in which the locking portion 62 of the locking lever 56 abuts against a cartridge 64. With the prior art shot gun lacking such a component as the locking portion 62, a cartridge tends to be inclined to the axial line of a shot gun. In contrast, the shot gun of this invention prevents this inclination of a cartridge by means of the locking portion 62, namely, the spontaneous discharge of a cartridge 64.

In short, the shot gun of this invention prevents the disconnector 20 from regaining its original position, unless the trigger is fully brought back to its original position. If, therefore, the trigger 12 happens to remain pulled, the disconnector 20 does not push the sear, nor the hammer 42 hits a firing pin (not shown), thereby reliably preventing the spontaneous discharge of a cartridge. Further, since the disconnector 20 is not fully brought back to its original position, the locking lever 56 is fitted into the groove of a slider (not shown) to restrict the operation of a firing pin (not shown) for prevention of the spontaneous discharge of a cartridge. As mentioned above, the spontaneous discharge stop device of this invention, though of simple construction, not only restricts the individual operation of the hammer 42 and a firing pin (not shown), but also prevents a cartridge from being inclined to the axial line of a shot gun, thereby unfailingly effecting the prevention of the spontaneous discharge of a cartridge.

What is claimed is:

1. A shot gun comprising a trigger guard frame; a sear rotatably supported on said trigger guard frame; bias means for urging the sear; a disconnector provided with a pushing portion for pushing the sear against the biasing force of the bias means; a trigger movably fitted to the trigger guard frame; connecting means for coupling the disconnector with the trigger; a hammer supported on the trigger guard frame to be releasably engaged with the sear; and a bias mechanism for rotating the hammer when it is released from the sear, wherein there is further provided an engagement member integrally formed with the disconnector which, when the bias mechanism is actuated to rotate the hammer, is engaged with said bias mechanism to prevent the disconnector from pushing the sear again.

2. A shot gun according to claim 1, which further comprises locking lever means swingably supported at the center portion on a frame and provided at one end with a locking portion pressed against a cartridge to keep it in a prescribed position, and interlocking means for moving said locking lever means jointly with the disconnector.

3. A shot gun according to claim 2 wherein the interlocking means includes a notch cut out at the other end of the locking lever means and a projection extending from the disconnector to be fitted into said notch.

4. A shot gun according to claim 3, wherein the sear is provided with a holding portion for holding the pushing portion of the disconnector, when the sear is released from a state pushed by the disconnector.

5. A shot gun according to claim 4 wherein the connecting means includes a pin member for connecting together the disconnector and trigger and an elongate hole bored in the disconnector so as to loosely receive another pin member for rotatably supporting the trigger on the frame.

6. A shot gun according to claim 5, wherein the bias mechanism is a plunger assembly consisting of a compression coil spring and a cap member for enclosing said compression coil spring.

7. A shot gun according to claim 6, wherein the hammer has a projection pressed against the cap member of the bias mechanism.

8. A shot gun according to claim 2, wherein the hammer and locking lever means are concentrically supported on the frame so as to be independently rotated.

* * * * *